US005909713A

United States Patent [19]

Liaw

[11] Patent Number: 5,909,713

[45] Date of Patent: Jun. 8, 1999

[54] FOLDABLE TABLE DEVICE

[76] Inventor: Ching-Tzong Liaw, 58, Ma Yuan West St., Taichung, Taiwan

[21] Appl. No.: 09/096,391

[22] Filed: Jun. 22, 1998

[51] Int. Cl.[6] ..... A47B 3/02

[52] U.S. Cl. ..... 108/119; 108/153.1

[58] Field of Search ..... 108/119, 153.1, 108/156, 157.1, 159.11, 108, 115, 135, 176, 167; 312/257.1, 250

[56] References Cited

U.S. PATENT DOCUMENTS 5,244,271 9/1993 Hackwood et al. ..... 108/156 X 5,269,239 12/1993 Nakamura ..... 108/153.1 X 5,461,989 10/1995 Grandclement et al. ..... 108/153.1

5,802,990 9/1998 Lin ..... 108/157.1

*Primary Examiner*—Jose V. Chen

[57] ABSTRACT

A foldable table device has an upper plate, a lower plate coupling with the upper plate, a drawer disposed on a bottom of the lower plate, a first link bar connected to the lower plate, a second link bar connected to the lower plate, a first leg plate connected to the first link bar, a second leg plate connected to the second link bar, a third leg plate connected to the lower plate, and a fourth leg plate connected to the lower plate.

4 Claims, 7 Drawing Sheets

FOLDABLE TABLE DEVICE

BACKGROUND OF THE INVENTION

The present invention relates to a foldable table device. More particularly, the present invention relates to a foldable table device which can be folded easily.

A conventional foldable table device has a plurality of screws and bolts to fasten elements of the conventional foldable table device. However, the screws and bolts may be loosened after a long period of usage.

SUMMARY OF THE INVENTION

An object of the present invention is to provide a foldable table device which can be folded easily.

Accordingly, a foldable table device comprises an upper plate, a lower plate coupling with the upper plate, a drawer disposed on a bottom of the lower plate, a first link bar connected to the lower plate, a second link bar connected to the lower plate, a first leg plate connected to the first link bar, a second leg plate connected to the second link bar, a third leg plate connected to the lower plate, and a fourth leg plate connected to the lower plate. The upper plate has a center hole, a plurality of radiating ribs disposed on a bottom of the upper plate, and a plurality of lower posts disposed on the bottom of the upper plate. The lower plate has a slot, a plurality of reinforced ribs, four hollow seats matching the lower posts, two generally U-shaped plates disposed on a bottom of the lower plate, and two linear plates disposed on the bottom of the lower plate. Each generally U-shaped plate has a rail bar, a shaft, and a pin. Each shaft has a needle. Each lower post is inserted in the respective hollow seat. Each of the first and the second leg plates has an end blind hole, a middle pivot having a step hole, and two snap grooves. Each snap groove has two inner recesses. Two snap fasteners are disposed in the end blind hole. Each of the first and the second link bars has a round hole, a step flange, and a hollow axle. The hollow axle is inserted in the respective end blind hole. Each shaft is inserted in the respective round hole. The step flange engages with the respective needle. The hollow axle is inserted in the respective end blind hole. Each of the third and the fourth leg plates has an end pillar, an end flange, and a middle recess hole. Two clip fasteners are disposed in the middle recess hole. The end flange engages with the respective pin. Each end pillar and each end flange are disposed between the respective linear plate and the respective U-shaped plates. The middle pivot is inserted in the respective middle recess hole. The clip fasteners engage with the step hole.

DETAILED DESCRIPTION OF THE INVENTION

Figure 1:
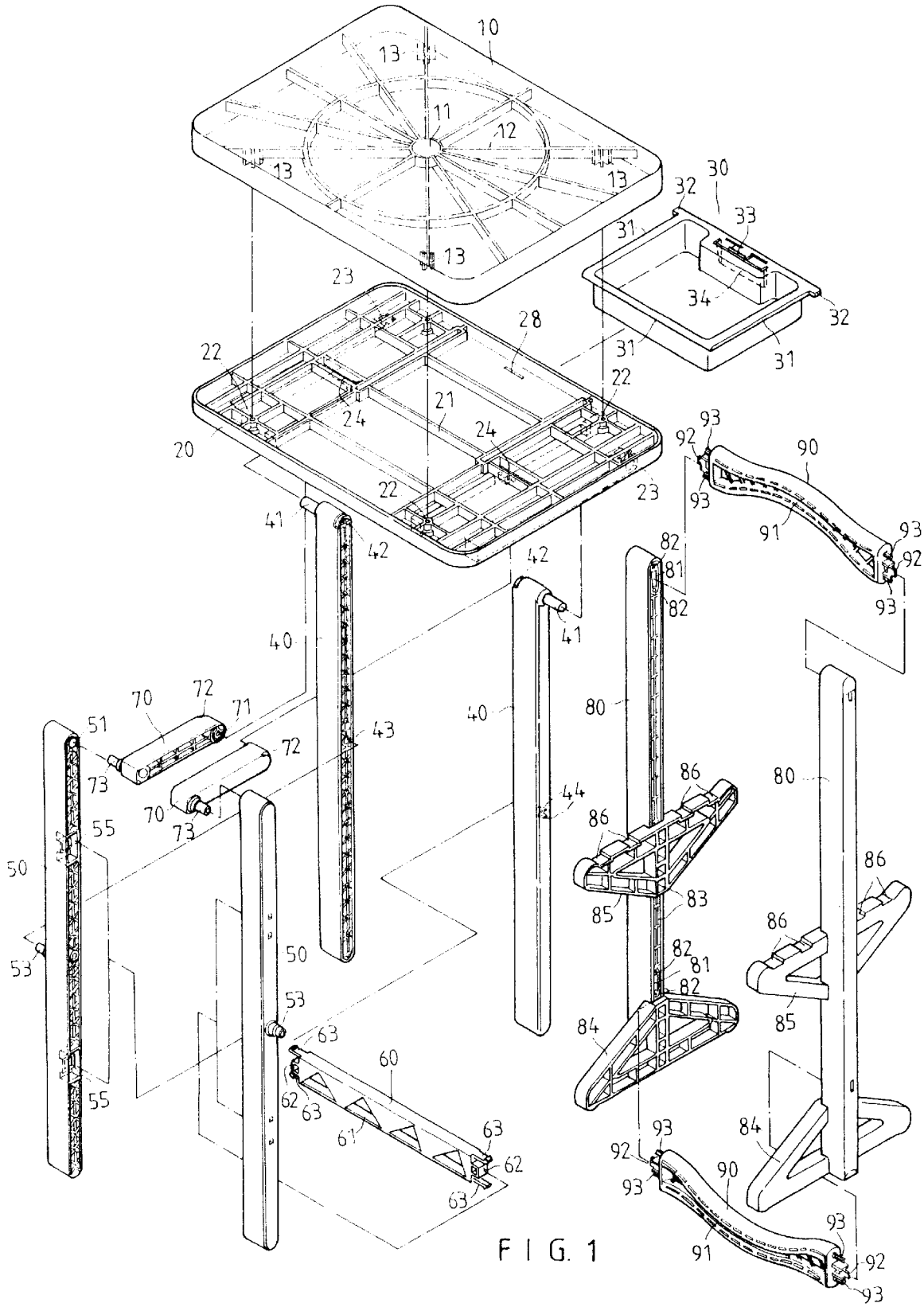
FIG. 1 is a perspective exploded view of a foldable table device of a preferred embodiment in accordance with the present invention.
Figure 1A:
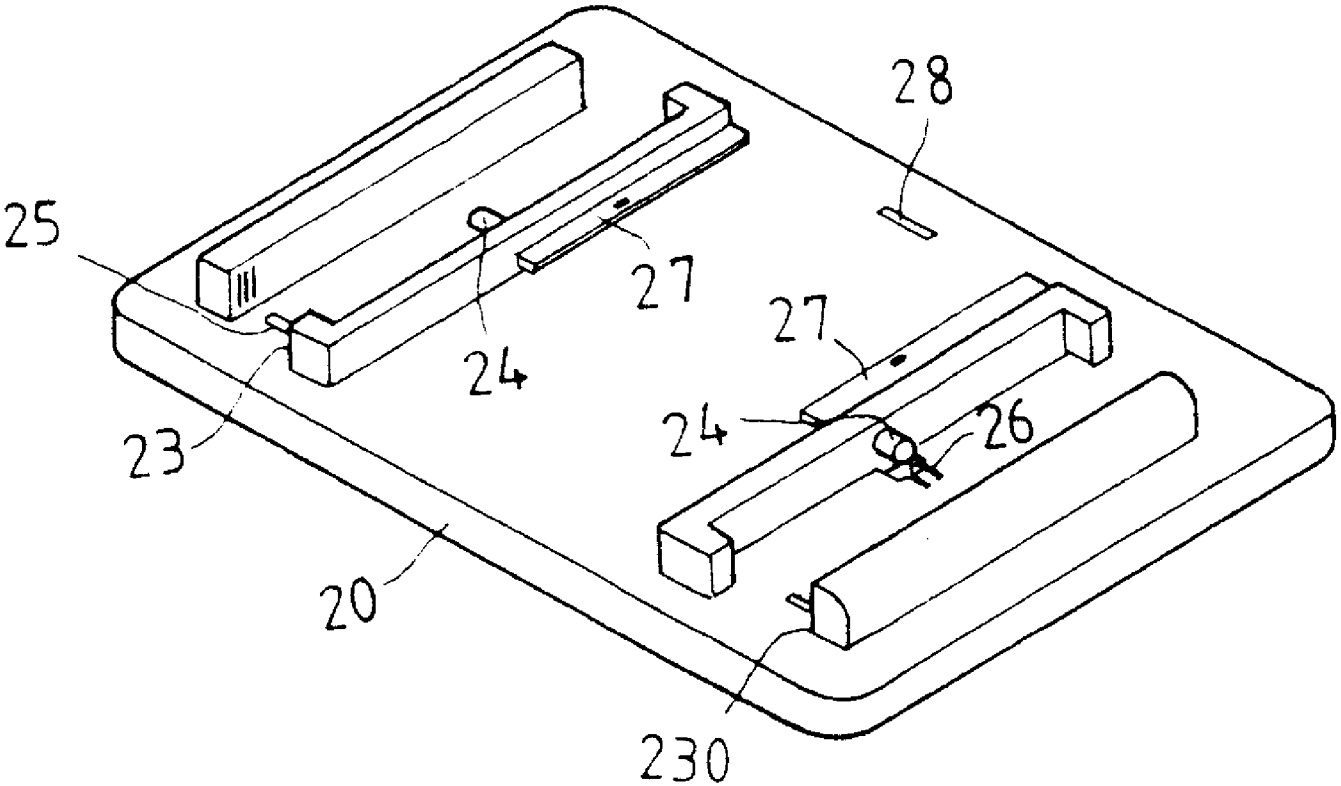
FIG. 1A is a bottom perspective view of a lower plate and a rack of a preferred embodiment in accordance with the present invention.
Figure 2:
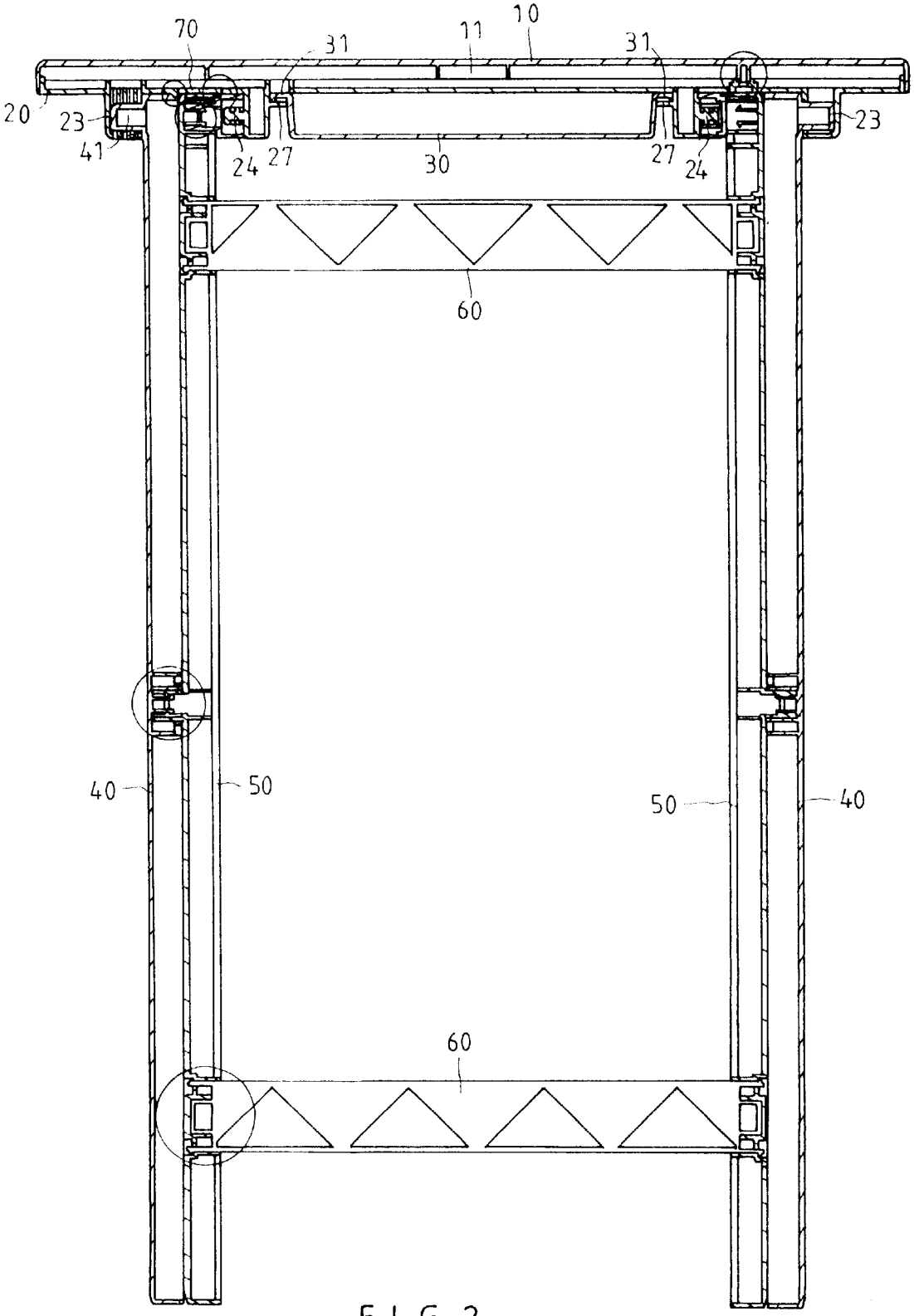
FIG. 2 is a sectional assembly view of a foldable table device of a preferred embodiment in accordance with the present invention.
Figure 2A:
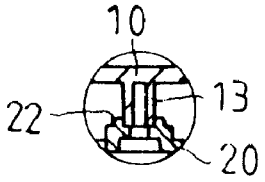
FIG. 2A is a partially sectional assembly view of a post and a hollow seat.
Figure 2B:
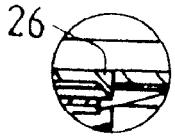
FIG. 2B is a partially sectional assembly view of a needle and a link bar.
Figure 2C:
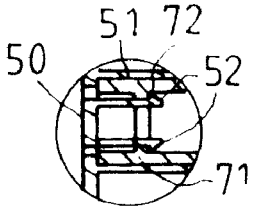
FIG. 2C is a partially sectional assembly view of a hollow axle and a blind hole of a first leg plate.
Figure 2D:
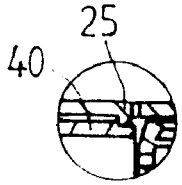
FIG. 2D is a partially sectional assembly view of a pin and a third leg plate.
Figure 2E:
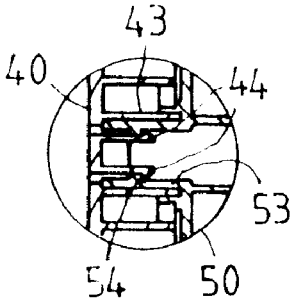
FIG. 2E is a partially sectional assembly view of a first leg plate and a third leg plate.
Figure 2F:
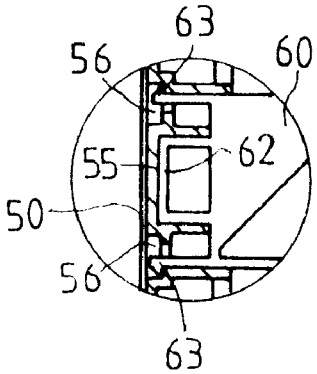
FIG. 2F is a partially sectional assembly view of a crossbar and a first leg plate.
Figure 4:
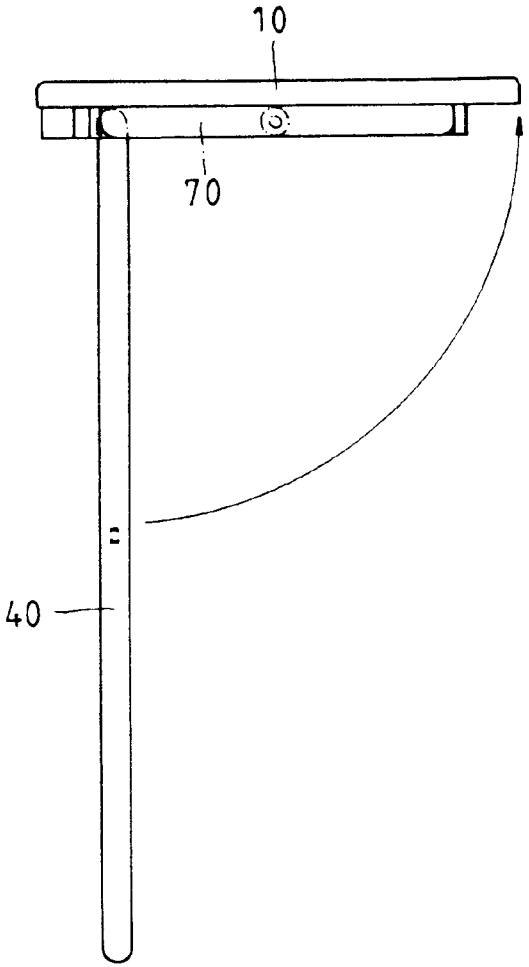
FIG. 4 is a schematic view illustrating an upper plate is extended.

Referring to FIGS. 1 to 4, a foldable table device comprises an upper plate 10, a lower plate 20 coupling with the upper plate 10, a drawer 30 disposed on a bottom of the lower plate 20, a first link bar 70 connected to the lower plate 20, a second link bar 70 connected to the lower plate 20, a first leg plate 50 connected to the first link bar 70, a second leg plate 50 connected to the second link bar 70, a third leg plate 40 connected to the lower plate 20, and a fourth leg plate 40 connected to the lower plate 20.

The upper plate 10 has a center hole 11, a plurality of radiating ribs 12 disposed on a bottom of the upper plate 10, and a plurality of lower posts 13 disposed on the bottom of the upper plate 10.

The lower plate 20 has a slot 28, a plurality of reinforced ribs 21, four hollow seats 22 matching the lower posts 13, two generally U-shaped plates 23 disposed on a bottom of the lower plate 20, and two linear plates 230 disposed on the bottom of the lower plate 20. Each generally U-shaped plate 23 has a rail bar 27, a shaft 24, and a pin 25. Each shaft 24 has a needle 26. Each lower post 13 is inserted in the respective hollow seat 22.

The drawer 30 has a periphery flange 31, two end block flanges 32, a push plate 34, and a clip hook 33 disposed on the push plate 34. Each rail bar 27 engages with the periphery flange 31 and is blocked by the respective end block flange 32. The clip hook 33 is inserted in the slot 28.

Each of the first and the second leg plates 50 has an end blind hole 51, a middle pivot 53 having a step hole 54, and two snap grooves 55. Each snap groove 55 has two inner recesses 56. Two snap fasteners 52 are disposed in the end blind hole 51.

Each of the first and the second link bars 70 has a round hole 71, a step flange 72, and a hollow axle 73. The hollow axle 73 is inserted in the respective end blind hole 51. Each shaft 24 is inserted in the respective round hole 71. The step flange 72 engages with the respective needle 26. The hollow axle 73 is inserted in the respective end blind hole 51.

Each of the third and the fourth leg plates 40 has an end pillar 41, an end flange 42, and a middle recess hole 43. Two clip fasteners 44 are disposed in the middle recess hole 43. The end flange 42 engages with the respective pin 25. Each end pillar 41 and each end flange 42 are disposed between the respective linear plate 230 and the respective U-shaped plates 23. The middle pivot 53 is inserted in the respective middle recess hole 43. The clip fasteners 44 engage with the step hole 54.

A crossbar 60 is disposed between the first and the second leg plates 50. The crossbar 60 has a reinforced bar 61, two opposite end blocks 62, and two pairs of opposite end teeth 63. Each end block 62 is inserted in the respective snap groove 55. Each pair of opposite end teeth 63 are inserted in the inner recesses 56.

The center hole 11 can receive an umbrella (not shown in the figures).

Figure 6:
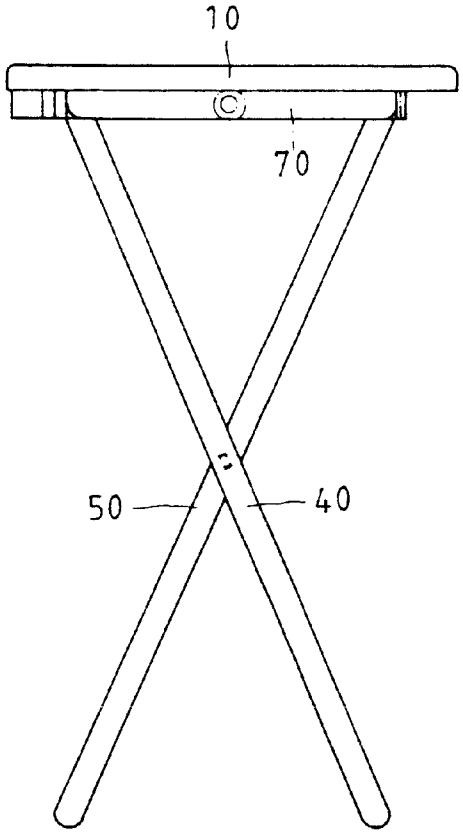
FIG. 6 is a schematic view illustrating a foldable table device is extended.
Figure 5:
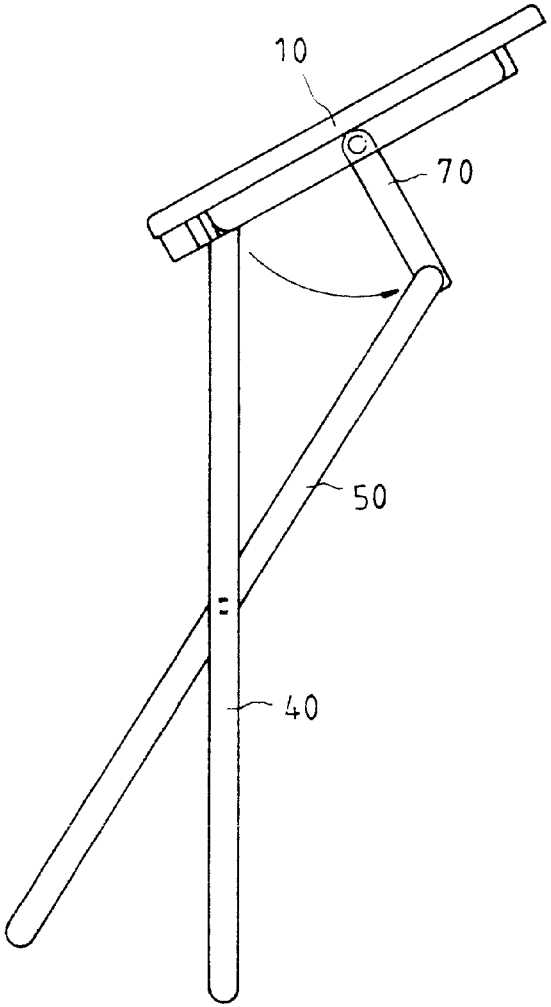
FIG. 5 is a schematic view illustrating a link bar is rotated.

Referring to FIG. 5, the upper plate 10 is lifted upward. The link bar 70 is rotated outward. Referring to FIG. 6, the foldable table device is extended.

Figure 3:
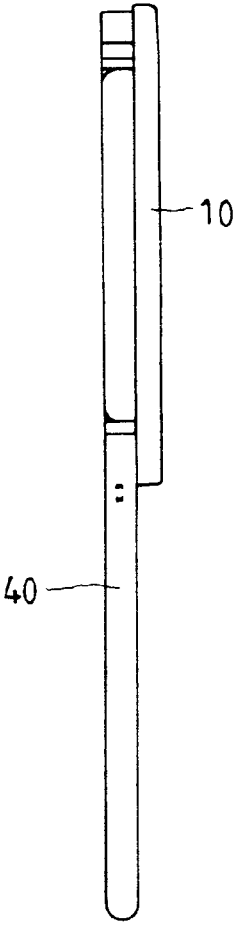
FIG. 3 is a schematic view illustrating an upper plate is folded.

Otherwise, the upper plate 10 is lifted upward. The link bar 70 is rotated inward. The first leg plate 50 and the third leg plate 40 are folded (as shown in FIG. 3).

Figure 7:
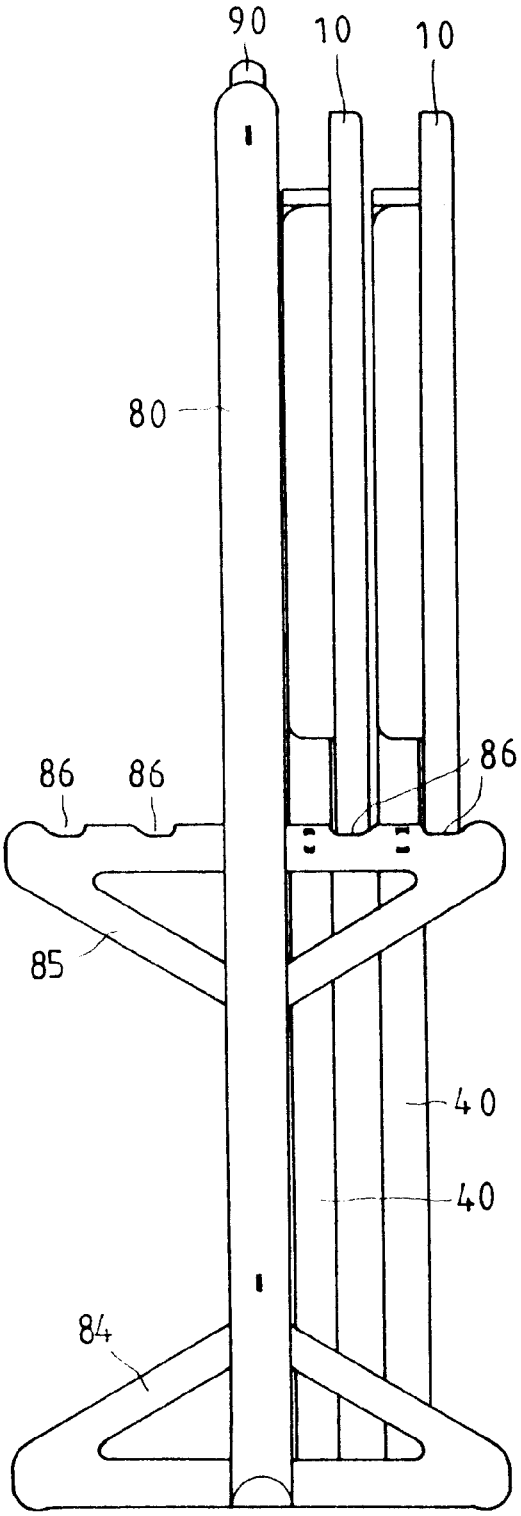
FIG. 7 is a schematic view illustrating at least a foldable table device is folded and placed on a hanger device.

Referring to FIGS. 1 and 7, a hanger device comprises two hanger support bars 80 and two handle bars 90 connected to the hanger support bars 80. Each hanger support bar 80 has a triangular hanger 85, a triangular seat 84, two channels 81, four snap holes 82, and a plurality of reinforced plates 83. Each triangular hanger 85 has a plurality of periphery recesses 86. Each handle bar 90 has a plurality of reinforced blocks 91, two opposite end protruded blocks 92, and two pairs of opposite end columns 63. Each end protruded block 92 is inserted in the respective channel 81. Each pair of end columns 63 are inserted in the respective snap holes 82.

The invention is not limited to the above embodiment but various modification thereof may be made. Further, various changes in form and detail may be made without departing from the scope of the invention.

I claim:

1. A foldable table device comprises:

an upper plate, a lower plate coupling with the upper plate, a drawer disposed on a bottom of the lower plate, a first link bar connected to the lower plate, a second link bar connected to the lower plate, a first leg plate connected to the first link bar, a second leg plate connected to the second link bar, a third leg plate connected to the lower plate, and a fourth leg plate connected to the lower plate, the upper plate having a center hole, a plurality of radiating ribs disposed on a bottom of the upper plate, and a plurality of lower posts disposed on the bottom of the upper plate, the lower plate having a slot, a plurality of reinforced ribs, four hollow seats matching the lower posts, two generally U-shaped plates disposed on a bottom of the lower plate, and two linear plates disposed on the bottom of the lower plate, each said generally U-shaped plate having a rail bar, a shaft, and a pin, each said shaft having a needle, each said lower post inserted in the respective hollow seat, each of the first and the second leg plates having an end blind hole, a middle pivot having a step hole, and two snap grooves, each said snap groove having two inner recesses, two snap fasteners disposed in the end blind hole, each of the first and the second link bars having a round hole, a step flange, and a hollow axle, the hollow axle inserted in the respective end blind hole, each said shaft inserted in the respective round hole, the step flange engaging with the respective needle, each of the third and the fourth leg plates having an end pillar, an end flange, and a middle recess hole, two clip fasteners disposed in the middle recess hole, the end flange engaging with the respective pin, each said end pillar and each said end flange disposed between the respective linear plate and the respective U-shaped plates, the middle pivot inserted in the respective middle recess hole, and the clip fasteners engaging with the step hole.

2. A foldable table device as claimed in claim 1, wherein a crossbar is disposed between the first leg plate and the second leg plate.

3. A foldable table device as claimed in claim 1, wherein the foldable table device further comprises a hanger device.

4. A foldable table device as claimed in claim 3, wherein the hanger device comprises two hanger support bars and two handle bars connected to the hanger support bars, and each said hanger support bar has a triangular hanger and a triangular seat.

* * * * *